United States Patent [19]

King

[11] 4,380,560

[45] Apr. 19, 1983

[54] PROCESS FOR TREATMENT OF BLACK PLATE CONTAINERS

[75] Inventor: Peter F. King, Farmington Hills, Mich.

[73] Assignee: Occidental Chemical Corporation, Warren, Mich.

[21] Appl. No.: 331,487

[22] Filed: Dec. 17, 1981

[51] Int. Cl.[3] ..... B05D 1/18; B05D 1/38; B05D 7/22; B05D 7/26

[52] U.S. Cl. ..... 427/239; 427/319; 427/328; 427/389; 427/383.7; 427/388.1; 427/388.2; 427/405; 427/436

[58] Field of Search ..... 427/239, 319, 328, 380, 427/383.7, 388.1, 388.2, 405, 436

[56] References Cited

U.S. PATENT DOCUMENTS 3,594,197 7/1971 Bunevich et al. ..... 427/436
4,027,055 5/1977 Schneble ..... 427/405 X
4,234,631 11/1980 Davis ..... 427/436

*Primary Examiner*—James R. Hoffman
*Attorney, Agent, or Firm*—Richard P. Mueller

[57] ABSTRACT

A process for treating food and beverage containers comprised of low-carbon steel sheet (black plate) to improve the adherence and to resist undercutting of organic can lacquers applied to the surfaces thereof when subjected to agressive environments without visually impairing the light-grey shiny steel appearance of the container surface and without loss of humidity resistance. The treatment can readily be integrated with conventional can body manufacturing procedures and includes contacting the cleaned black plate container body surface with an aqueous acidic solution containing a controlled amount of stannous ions at a controlled temperature for a period of time sufficient to deposit tin on the surfaces thereof in an amount up to about 5 mg/ft$^2$ followed by rinsing, drying and lacquering.

20 Claims, No Drawings

PROCESS FOR TREATMENT OF BLACK PLATE CONTAINERS

BACKGROUND OF THE INVENTION

Containers employed in the packaging of foodstuffs and beverages conventionally are comprised of a variety of materials providing a thin-walled resilient construction. Among such materials which can be satisfactorily used are low-carbon steel sheet, commonly referred to as black plate, which can readily be fabricated into container bodies employing conventional cupping and draw and ironing press operations providing economic advantages over aluminum, plastic materials and tin-plated steel sheet. Such drawn and ironed black plate container bodies are characterized as having a desirable light-grey shiny steel surface appearance which provides for an attractive package after subsequent coating with a clear organic lacquer and imprinting ink indicia on the exterior can surface.

During recent years, tests have developed for evaluating the adhesion of the lacquer coating to the surfaces of such black plate containers and the corrosion resistance or resistance to undercutting of the organic lacquer coating adjacent to scratches or imperfections or discontinuities in the lacquer coating. One such test which has received industry acceptance is a so-called "citric acid test" as more fully described in an article entitled "The Undercutting of Organic Lacquers on Steel" by O. D. Gonzalez, P. H. Josephic and R. A. Oriani as published in the Journal of the Electrochemical Society, Volume 121, No. 1, of January, 1974. Briefly stated, the test comprises preparing an aqueous solution containing 15 grams of citric acid and 15 grams of sodium chloride per liter in tap water. Black plate container bodies after cleaning, are dip-coated with a phenolic lacquer to provide a dry coating weight of about 7.2 to 8.8 mg/in$^2$ and the lacquer coating is air dried for ten minutes followed by curing for ten minutes at about 410° F. The lacquered can bodies are scratched to provide a test area and are immersed in the salt-citric acid solution at room temperature for a period of about four days. At the completion of the test period, the samples are removed, blotted dry and the amount of undercutting of the lacquer from the scratch or score line to the nearest 0.1 millimeter (mm) is measured. The salt-citric acid test provides an agressive environment and there has been a need for an improved treatment of the black plate container body surfaces which increases the adhesion of the lacquer coating to the surface and also resists undercutting of the lacquer coating when subjected to the salt-citric acid test. Such treatment must also provide a surface which retains humidity resistance such as measured during a 16 to 24 hour exposure to 100 percent relative humidity after cleaning and before lacquering while being sheltered from direct condensation in the humidity chamber. The treatment must further not visually detract from the shiny, light-grey metallic appearance of the surface of the container body. Because of this, conversion coatings such as phosphate and chromate coatings are unsatisfactory from an appearance standpoint. Also, chromates are becoming ecologically unacceptable. It is also desirable that such treatment be integrated into conventional container body manufacturing procedures without a disruption of production capacity and control.

The treating process of the present invention attains the aforementioned objectives providing an economical integrated treatment of black plate container bodies achieving increased resistance to lacquer undercutting without loss of humidity resistance and without detrimentally affecting the shiny light-grey metallic appearance of the container surfaces.

SUMMARY OF THE INVENTION

The benefits and advantages of the present invention are achieved by a process for treating food and beverage container bodies comprised of black plate which improves the adherence of the lacquer coating and resists undercutting of the organic lacquer coating when subjected to the salt-citric acid test while simultaneously retaining the desired light-grey shiny metallic steel appearance of the container surface and without loss of humidity resistance. The treating step can readily be integrated into conventional container body manufacturing systems and can advantageously be incorporated in the washer section of such process following the cleaning steps and prior to the water rinsing, drying and final lacquering and curing steps. The treatment comprises subjecting the clean surfaces of the container body to contact with an aqueous acidic solution containing stannous ions in an amount of about 0.01% by weight up to saturation at a temperature ranging from about room temperature to about 200° F. preferably 150° F. for a period of time to deposit tin on the container body surfaces in an amount of up to about 5 milligrams per square foot (mg/ft$^2$) without visually changing the shiny grey surface appearance thereof. Preferably, the treatment is controlled to provide a tin deposit of from about 0.5 to about 4 mg/ft$^2$. After the treatment, the surfaces of the container body are subjected to one or more water rinse treatments followed by drying such as in a recirculating air oven, preferably after the major portion of residual liquid has been blown off the surfaces of the container body. Thereafter one or a plurality of organic can lacquer coatings of the types conventionally employed are applied to the interior and to the exterior surfaces of the container body with intervening elevated temperature curing steps.

Additional benefits and advantages of the present invention will become apparent upon a reading of the description of the preferred embodiments taken in conjunction with the specific examples provided.

DESCRIPTION OF THE PREFERRED EMBODIMENTS

The manufacturing sequence for producing black plate container bodies into which the present invention can readily be integrated conventionally comprises uncoiling a black plate steel strip having a protective oil layer on the surface thereof to which further drawing lubricants are applied after which the strip passes through a cupping press forming a preliminary cup-shaped disc which is transferred to a draw and ironing press producing an elongated cup-shaped body and during which further coolant such as water or dilute aqueous emulsions are applied to facilitate the drawing operation. The container bodies are thereafter transferred to a trimmer in which the upper edge is trimmed whereafter the trimmed body passes through a washer containing multiple stages which usually comprise a pre-washing stage in which water containing a low concentration of a cleaner is applied followed by a cleaning step in which an alkali cleaner of conventional strength is applied to remove the various lubricants, protective oils, coolants and other contaminating substances on the surfaces of the container body. The cleaned container bodies are thereafter subjected to a water rinse whereafter they pass into the treatment stage of the present invention and are normally followed by a water rinse and a final deionized water rinse. The rinsed, cleaned, and treated container body is thereafter transferred to a dry-off oven and the dry container body is subjected to one or a plurality of lacquering steps and exterior decorative printing steps. Typically, upon emergence from the dryer, the exterior surface of the container body is first provided with a decorative ink printing of suitable indicia which after drying is followed by a conventional exterior can lacquer coating and a curing of the lacquer coating by heating to an elevated temperature such as about 400° F. for a period of about ten minutes. Thereafter, an interior can lacquer coating of the types conventionally employed is applied to the interior surfaces of the container body and is selected so as to chemically withstand the foodstuff or beverages to be filled within the container in a subsequent filling station. The interior lacquer coating is again cured at an elevated temperature and the container may optionally be subjected to a second interior lacquer coating and further elevated temperature curing step before transfer to the filling station.

The treatment of the present invention can readily be integrated in the washer section of convenional steel container body processing systems as an alternative to one of a multiple water rinse treatments without disruption of the container processing sequence. Conventionally, the various solutions in the washer section are applied to the container body surfaces by spray application because of configuration of the articles to be processed and such spray application is eminently satisfactory for applying the treating solution in accordance with the present process although immersion, flooding, etc. can also be satisfactorily employed.

Each of the stages in the washer section may vary from about 15 seconds to about one minute and the treatment of the present invention can readily be incorporated and integrated in the time sequence of such stages typically providing a treating period of about 15 seconds up to about one minute.

The treatment solution employed for contacting the cleaned surfaces of the black plate container body comprises an aqueous acidic solution containing stannous ions in a range of about 0.01% by weight up to saturation, with amounts of from about 0.025 to about 0.9% by weight being usually preferred. The stannous ions can be conveniently introduced into the aqueous solution employing any aqueous soluble and compatible salt of which halide salts or stannous sulfate are preferred. Particularly satisfactory salts are stannous chloride and stannous sulfate as well as mixtures thereof.

Since the stannous ion is progressively consumed during use, a replenishment of the stannous ion concentration to maintain it within the permissible operating concentrations can be achieved by directly adding the dry salts to the treating solution supply tank, or alternatively, by adding a concentrate such as about 10 percent by weight of the stannous salt dissolved therein.

The treating solution further contains hydrogen ions in an amount sufficient to provide an acidic medium which generally ranges from a pH of about 1 up to about 4. Since it has been observed that at pH levels above about 3.5, the resistance to creep or undercutting of the lacquer coating diminishes during a salt-citric acid test, it is usually preferred to maintain the pH below about 3.5. Preferably the pH is maintained within a range of about 1.5 to about 3 with a range of about 2.0 to about 2.8 being particularly satisfactory.

When alkaline cleaners are employed in the steps preceding the treatment step, some drag-in of the alkaline cleaner residue may require adjustment of the pH of the treating solution to maintain it within proper operating limits. For this purpose, mineral acids such as hydrochloric acid or sulfuric acid can be satisfactorily employed. Phosphoric acid is undesirable because it tends to form a visible phosphate coating on the surface of the container body detracting from its appearance. During use of the treating solution, some contamination with iron ions can occur but such contamination up to saturation with iron has not been found to produce any detrimental effects on the adherence and corrosion protection imparted by the treating step.

The treating solution is applied such as by spray application at a temperature broadly ranging from about room temperature (70° F.) up to about 150° F. Since temperatures at or above about 150° F. increase the tendency of the stannous ions to become oxidized to stannic ions, it is preferred to employ temperatures below 150° F. Preferably, temperatures of about 80° to about 100° F. have been found to produce best results and are economical from an energy conservation standpoint.

The time or duration of contact of the treating solution with the container body surface will vary depending upon the particular method by which it is applied, the temperature of the solution, the concentration of stannous ions therein, and the desired deposition of tin on the surface. Usually, the specific time is dictated to a large extent by the specific time sequence of the washer employed in processing the container bodies. While times ranging from about 5 seconds to as long as 45 minutes can be employed, typical washer cycles provide treatment times ranging from about 15 seconds to about one minute.

The foregoing variables in composition and processing parameters are controlled so as to prevent any substantial visual alteration in the shiny, light-grey metallic appearance of the container surface. Accordingly, the composition and process parameters are adjusted so as to control the deposition of tin on the container surface in an amount less than about 5 mg/ft$^2$ and preferably within a range of about 0.5 up to about 4 mg/ft$^2$. It has been observed that tin deposits of a magnitude of only 0.5 mg/ft$^2$ are usually necessary to attain the benefits of the present invention and provide for a marked improvement in the treated and lacquered container body in comparison to cleaned-only container surfaces.

In order to further illustrate the process of the present invention, the following examples are provided. It will be understood that the examples are provided for illustrative purposes and are not intended to be limiting of the scope of the present invention as herein described and as set forth in the subjoined claims.

EXAMPLE 1

Two sets comprising two drawn and ironed black plate steel cans derived from the container body maker and trimmer were subjected to a series of liquid spray treatments to produce a pair of cleaned-only cans and a pair of treated cans. The cleaned-only cans were subjected to a spray sequence including a cleaning step employing two ounces per gallon of a commercial alkaline cleaner followed by a warm water rinse at 150° F., a cold water rinse, a de-ionized water rinse followed by drying. The treated cans were subjected to an identical sequence with the exception that following the warm water rinse at 150° F., the surfaces of the cans were subjected to an aqueous acidic spray treatment at 120° F. for a period of 60 seconds with a solution containing 20 grams of stannous chloride in 20 liters of water (about 0.1% by weight) at a nominal pH of 2.5. Following the treatment in the aqueous stannous solution, the treated cans similarly were cold water rinsed, de-ionized water rinsed and dried.

One of the cleaned-only and one of the treated cans were further lacquered after drying employing a commercial water-based can lacquer available from Glidden under the designation No. 640-L-515E, comprising a cold water reducible spray liner for 2 piece steel and aluminum cans of a modified epoxy, phenolic type.

A test coupon was cut from the unlacquered cleaned-only and treated cans and was subjected to a humidity test at 100% relative humidity at 100° F. for a period of 16 hours. A visual inspection revealed that the test coupon from the cleaned-only can at the conclusion of the humidity test exhibited about 3% rust over its surface area whereas the treated test coupon exhibited about 5% rust over its area.

Test coupons were also cut from the lacquered cleaned-only and treated cans and subjected to the salt-citric acid test in a solution containing 1½% by weight citric acid and 1½% by weight sodium chloride at room temperature. Before immersion of the lacquered test coupons in the salt-citric acid solution, each coupon is scribed through the lacquer coating.

At the completion of the three-day test period, the cleaned-only test coupon evidenced an undercutting or creepage of rust from each side of the scribe line of a magnitude of about 3 mm whereas the treated test coupon evidenced no undercutting or creepage from the scribe line.

EXAMPLE 2

A second set of two cans each were subjected to a spray treating sequence as previously described in connection with Example 1 with the exception that the treated cans were subjected to an alternative treating solution containing 20 grams of stannous sulfate per five gallons (about 0.1% by weight) at a temperature of 120° F. for a period of 60 seconds and a nominal pH of about 2.5. Before actual treatment of the black plate can surfaces with the aqueous stannous sulfate solution, the solution was aged with five steel panels for about one-half hour and this aging treatment was repeated five times. At the completion of the aging period the solution was replenished with 39 additional grams of stannous sulfate and 5.4 milliliters of 50% sulfuric acid to adjust the pH to about 2.1.

As in Example 1, test coupons were cut from the unlacquered cleaned-only containers and from the aqueous stannous sulfate treated containers and subjected to the humidity test. After about 16 hours exposure, the test coupons were inspected and neither of the coupons evidenced any significant rust on the test coupon surfaces. Similarly, the lacquered containers were employed for preparing scribed test coupons which were subjected to the same salt-citric acid test as described in Example 1. The lacquered cleaned-only test coupons evidenced an average creepage or undercutting at the scribe line ranging from 2 to about 3 millimeters whereas test coupons of the treated containers evidenced a creepage or undercutting of from 0 up to 1 millimeter.

EXAMPLE 3

The treating process of the present invention also exhibits benefits in connection with the inhibition or prevention of discoloration of the exterior can surface as a result of thermal cycling resulting from a multiple curing at elevated temperature of a plurality of lacquer coatings applied to the interior and exterior surfaces of such black plate containers in accordance with conventional can manufacturing procedures. A drawn and ironed black plate steel container is subjected to a series of solution spray steps in a manner similar to those described in Example 1 including a spray cleaning step, a hot water rinse, a tap water rinse at room temperature and a de-ionized room temperature water rinse followed by oven drying at a temperature of about 350° F. A second black plate can is subjected to the same spray sequence with the exception that the surfaces of the container following the hot water rinse and prior to the cold tap water rinse is subjected to spray treatment employing an aqueous acidic solution containing about 0.3% by weight of stannous sulfate at a temperature of 120° F. for a period of about one minute and at a nominal pH of about 2.1.

Both the cleaned-only and cleaned and treated cans are thereater provided with an exterior lacquer coating employing a conventional clear can lacquer comprising a water borne epoxy commercially sold under the designation Celanese CC 3421 TN 70638. Thereafter the lacquer coating is cured at a temperature of about 350° F. for a period of two and one-half minutes. The interior of each can is thereafter lacquered with a conventional inside lacquer coating and is cured in an oven at about 400° F. for about two and one-half minutes after which the can is again cooled and a second interior lacquer coating is applied followed by a second curing in an oven at about 400° F. for an additional two and one-half minutes.

At the conclusion of the third curing cycle, the exterior surfaces of the cans are visually inspected. The lacquered cleaned-only can is observed to have an undesirable tarnish on the exterior surfaces providing an objectionable brown exterior appearance. On the other hand, the cleaned and treated can in accordance with the present invention retains a satisfactory shiny, metallic grey steel color.

While it will be apparent that the preferred embodiments of the invention disclosed are well calculated to fulfill the objects above stated, it will be appreciated that the invention is susceptible to modification, variation and change without departing from the proper scope or fair meaning of the subjoined claims.

What is claimed is:

1. A process for treating black plate containers to improve corrosion resistance and lacquer adherence which comprises the steps of providing a formed black plate container body, cleaning the surfaces of the body to remove contaminants therefrom, contacting the clean body surfaces with an aqueous acidic solution containing stannous ions in an amount of about 0.01% up to saturation at a temperature of about room temperature to about 200° F. for a period of time to deposit tin on the body surfaces in an amount up to about 5 mg/ft$^2$ without visually changing the shiny grey surface appearance thereof, water rinsing and drying the treated body, and thereafter applying an organic lacquer coating to the dry, treated body surfaces.

2. The process as defined in claim 1 in which said stannous ions are controlled in an amount of about 0.025 to about 0.9 percent by weight.

3. The process as defined in claim 1 in which said stannous ions are introduced into said aqueous acidic solution as a salt selected from the group consisting of halides, sulfates, and mixtures thereof.

4. The process as defined in claim 1 in which the pH of said aqueous acidic solution is controlled at a level below about 4.

5. The process as defined in claim 1 in which the pH of said aqueous acidic solution is controlled within a range of about 1 to about 4.

6. The process as defined in claim 1 in which of pH of said aqueous acidic solution is controlled at a level below about 3.5.

7. The process as defined in claim 1 in which the pH of said aqueous acidic solution is controlled within a range of about 1.5 to about 3.

8. The process as defined in claim 1 in which the pH of said aqueous acidic solution is controlled within a range of about 2 to about 2.8.

9. The process as defined in claim 1 in which the temperature of said aqueous acidic solution is controlled within a range of about 80° to about 100° F.

10. The process as defined in claim 1 in which the contacting of the body surfaces with said aqueous acidic solution is performed to provide a tin deposit on the body surfaces in an amount less than about 4 mg/ft$^2$.

11. The process as defined in claim 1 in which the contacting of said body surfaces with said aqueous acidic solution is performed to deposit tin in an amount of about 0.5 to 4 mg/ft$^2$ on the body surfaces.

12. The process as defined in claim 1 in which the body surfaces are contacted with said aqueous acidic solution for a period of time of about 5 seconds up to about 45 minutes.

13. The process as defined in claim 1 in which the contacting of the body surfaces with said aqueous acidic solution is performed for a period of time ranging from about 15 seconds to about one minute.

14. The process as defined in claim 1 in which said stannous ions are introduced in said aqueous acidic solution as stannous chloride.

15. The process as defined in claim 1 in which said stannous ions in said aqueous acidic solution are introduced as stannous sulfate.

16. The process as defined in claim 1 in which the step of applying an organic lacquer coating to the dry, treated body surfaces is performed to provide a substantially clear lacquer coating.

17. The process as defined in claim 1 including the further step of heating the container body with the lacquer coating thereon to an elevated temperature to cure said coating.

18. The process as defined in claim 1 in which the step of applying an organic lacquer coating to the treated body surfaces is performed to provide a plurality of coatings with intervening curing steps at elevated temperature.

19. In the process for manufacturing black plate container bodies which includes forming the container body from a low-carbon steel sheet, cleaning the formed body, drying the cleaned body and lacquering the shiny steel grey surfaces of the cleaned, dry body, the improvement comprising treating the surfaces of the body following the cleaning and before the drying steps to improve the corrosion resistance and adherence of the lacquer without visually changing the appearance of the body surface, said treating step comprising contacting the clean body surfaces with an aqueous acidic solution at a pH below about 4 containing stannous ions in an amount of about 0.01% by weight up to saturation at a temperature of about room temperature to about 200° F. for a period of time to deposit tin on the body surfaces in an amount up to about 5 mg/ft$^2$, and thereafter water rinsing the treated surfaces prior to drying.

20. In the process for manufacturing black plate container bodies which includes forming the container body from a low-carbon steel sheet, cleaning the formed body, drying the cleaned body and lacquering the shiny steel grey surfaces of the cleaned, dry body, the improvement comprising treating the surfaces of the body following the cleaning and before the drying steps to improve the corrosion resistance and adherence of the lacquer without visually changing the appearance of the body surface, said treating step comprising contacting the clean body surfaces with an aqueous acidic solution at a pH of about 1.5 to about 3 containing stannous ions in an amount of about 0.025 to about 0.9% by weight at a temperature of about 80° F. to about 100° F. for a period of time to deposit tin on the body surfaces in an amount of about 0.5 to about 4 mg/ft$^2$, and thereafter water rinsing the treated surfaces prior to drying.

* * * * *